US005948180A

United States Patent [19]

Tomida et al.

[11] Patent Number: 5,948,180

[45] Date of Patent: Sep. 7, 1999

[54] DOUBLY ORIENTED MAGNETIC STEEL SHEET AND METHOD FOR MANUFACTURING THE SAME

[75] Inventors: Toshiro Tomida; Shigeo Uenoya; Naoyuki Sano, all of Osaka, Japan

[73] Assignee: Sumitomo Metal Industries, Ltd., Osaka, Japan

[21] Appl. No.: 09/106,361

[22] Filed: Jun. 29, 1998

Related U.S. Application Data

[63] Continuation of application No. PCT/JP97/03985, Oct. 30, 1997.

[30] Foreign Application Priority Data

Nov. 1, 1996 [JP] Japan ..... 8-291375

[51] Int. Cl.[6] ..... H01F 1/04

[52] U.S. Cl. ..... 148/308; 310/216; 336/218

[58] Field of Search ..... 148/308, DIG. 115; 310/216; 336/218

[56] References Cited

U.S. PATENT DOCUMENTS

| | | | |
|---|---|---|---|
| 3,337,373 | 8/1967 | Foster et al. | 148/308 |
| 5,714,017 | 2/1998 | Tomida et al. | 148/308 |

FOREIGN PATENT DOCUMENTS

| | | |
|---|---|---|
| 1-108345 | 4/1989 | Japan . |
| 1-252727 | 10/1989 | Japan . |
| 2-156024 | 6/1990 | Japan . |
| 3-24251 | 2/1991 | Japan . |
| 7-173542 | 7/1995 | Japan . |

*Primary Examiner*—John P. Sheehan
*Assistant Examiner*—Andrew L. Oltmans
*Attorney, Agent, or Firm*—Burns, Doane, Swecker & Mathis, LLP

[57] ABSTRACT

(1) A doubly oriented silicon steel sheet having excellent magnetic characteristics in two directions, i.e. in a rolling direction and in a direction perpendicular to the rolling direction, and most suited for use as material for cores of small-sized transformers, and (2) a method for manufacturing the same. The doubly oriented silicon steel sheet as mentioned above in (1) is characterized in that: Si and Mn are contained in amounts which satisfy a predetermined formula of relation; an average crystal grain is as large as 1 to 8 times the thickness of the sheet as measured on a cross section parallel to the surface of the sheet; and at least 60% of all crystal grains have a size of X/3 to 3X, where X is an average grain size. In the doubly oriented silicon steel sheet, preferably, crystal grains having a crystallographic orientation difference within ±15 degrees from a cubic orientation of {100}<001> occupy an areal percentage of not less than 70%, or the thickness of a surface oxide layer of the steel sheet is not greater than 0.5 μm. The method for manufacturing a doubly oriented magnetic steel sheet as mentioned above in (2) includes the steps of hot-rolling and cold-rolling steel containing C in an amount of 0.02% to 0.2% and Si and M in amounts satisfying a predetermined formula of relation, wherein annealing is performed at a temperature not lower than 750° C. and through quick application of heat during cold rolling; and the obtained steel sheet is annealed under reduced pressure through use of an annealing separator. In this method for manufacturing a doubly oriented magnetic steel sheet, preferably, a rolling reduction is 40% to 85% in cold rolling performed before and after intermediate annealing.

20 Claims, 5 Drawing Sheets

Fig. 1

| Steel | Chemical Composition (wt.%) | | | | | | | Si+Mn/2 | Si−Mn/2 | Remarks |
|---|---|---|---|---|---|---|---|---|---|---|
| | C | Si | Mn | P | S | N | Al | | | |
| A | 0.042 | 2.02 | 0.50 | <0.001 | 0.001 | 0.006 | <0.001 | 2.27 | 1.77 | Present Invention |
| B | 0.061 | 2.31 | 0.89 | 0.010 | 0.004 | 0.010 | 0.021 | 3.20 | 1.87 | |
| C | 0.092 | 2.55 | 1.60 | 0.005 | 0.001 | 0.003 | 0.003 | 3.35 | 1.75 | |
| D | 0.052 | 2.88 | 1.02 | <0.001 | 0.003 | 0.002 | <0.001 | 3.39 | 2.37 | |
| E | 0.048 | 3.12 | 1.20 | <0.001 | 0.007 | 0.008 | <0.001 | 3.72 | 2.52 | |
| F | 0.103 | 3.40 | 0.76 | <0.001 | 0.010 | 0.001 | <0.001 | 3.78 | 3.02 | |
| G | 0.024 | 3.08 | 0.08 | 0.003 | 0.005 | 0.004 | 0.005 | 3.12 | 3.04 | |
| H | 0.059 | 2.76 | <0.01 | 0.007 | <0.001 | 0.006 | 0.004 | 2.76 | 2.76 | |
| I | 0.053 | 0.89 | 0.30 | <0.001 | 0.003 | 0.002 | <0.001 | 1.04 | * 0.74 | Comparative Example |
| J | 0.075 | 4.03 | 0.12 | 0.002 | 0.002 | 0.004 | 0.004 | * 4.09 | 3.97 | |
| K | * 0.011 | 2.85 | 0.85 | 0.003 | 0.001 | 0.002 | 0.001 | 3.28 | 2.43 | |
| L | * 0.008 | 3.02 | 0.05 | 0.001 | 0.001 | 0.003 | 0.002 | 3.05 | 3.00 | |

Note: A value marked with *falls outside the range as defined in the present invention.

Fig. 2

| Test No. | Steel | Intermediate annealing | | | Magnetic Characteristics | | | | Crystal Grains | | Areal percentage of grains having orientation deviation within ±15 degrees from cubic orientation (%) | Remarks |
|---|---|---|---|---|---|---|---|---|---|---|---|---|
| | | Elapsed time for passing tmp.zone of 600-750 ℃ (s) | Soaking Temp. (℃) | Soaking Time (min) | Core loss in rolling direction $W_{17/50}$ (W/kg) | Magnetic flux density in rolling direction $B_{10}$ (T) | Core loss in width direction $W_{17/50}$ (W/kg) | Magnetic flux density in width direction $B_{10}$ (T) | Ratio of average grain size to sheet thickness X/t | Areal percentage of grains having of X/3-3X (%) | | |
| 1 | D | *300 | 925 | 1 | 3.24 | 1.484 | 3.36 | 1.464 | * 9.1 | * 62 | * 10 | Comparative example |
| 2 | D | *150 | 925 | 1 | 3.05 | 1.495 | 3.26 | 1.457 | * 8.9 | * 69 | * 12 | // |
| 3 | D | 25 | 925 | 1 | 1.45 | 1.725 | 1.65 | 1.705 | 3.7 | 82 | 81 | Present invention |
| 4 | D | 10 | 925 | 1 | 1.28 | 1.782 | 1.34 | 1.785 | 2.5 | 86 | 86 | // |
| 5 | D | 7.5 | 925 | 1 | 1.12 | 1.835 | 1.18 | 1.832 | 2.2 | 92 | 93 | // |
| 6 | D | 5.0 | 925 | 1 | 1.06 | 1.864 | 1.09 | 1.853 | 1.9 | 84 | 97 | // |
| 7 | D | 3.8 | 925 | 1 | 0.99 | 1.895 | 0.98 | 1.903 | 2.2 | 81 | 94 | // |
| 8 | A | 6.8 | 925 | 2 | 1.45 | 1.875 | 1.48 | 1.865 | 3.1 | 93 | 92 | // |
| 9 | B | 7.5 | 875 | 2 | 1.37 | 1.832 | 1.34 | 1.841 | 1.7 | 95 | 86 | // |
| 10 | C | 5.0 | 960 | 0.5 | 1.32 | 1.836 | 1.38 | 1.809 | 2.4 | 83 | 92 | // |
| 11 | E | 9.4 | 1020 | 0.5 | 0.98 | 1.910 | 1.04 | 1.895 | 2.7 | 85 | 95 | // |
| 12 | F | 5.8 | 875 | 0.2 | 1.02 | 1.865 | 1.00 | 1.879 | 2.3 | 86 | 96 | // |
| 13 | G | 15 | 1075 | 0.3 | 1.35 | 1.812 | 1.42 | 1.785 | 2.8 | 72 | 91 | // |
| 14 | H | 12 | 1000 | 0.4 | 1.56 | 1.774 | 1.61 | 1.756 | 3.2 | 75 | 85 | // |
| 15 | E | 5.0 | * 550 | 30 | 2.52 | 1.591 | 2.98 | 1.502 | 3.2 | * 52 | * 22 | Comparative example |
| 16 | E | 5.0 | * 675 | 5 | 3.92 | 1.482 | 4.32 | 1.441 | *11.8 | * 45 | * 17 | // |
| 17 | E | 5.0 | * 700 | 3 | 3.61 | 1.498 | 4.67 | 1.409 | * 9.2 | * 61 | * 28 | // |
| 18 | E | *150 | 900 | 2 | 2.81 | 1.521 | 4.30 | 1.451 | *13.7 | * 49 | * 12 | // |
| 19 | * I | 7.5 | 925 | 1 | 6.22 | 1.563 | 7.35 | 1.496 | 4.5 | * 62 | * 10 | // |
| 20 | * J | 7.5 | 925 | 1 | 3.96 | 1.483 | 4.32 | 1.435 | 5.5 | * 69 | * 12 | // |
| 21 | * K | 7.5 | 925 | 1 | 3.62 | 1.512 | 4.12 | 1.461 | * 8.2 | * 45 | * 8 | // |
| 22 | * L | 7.5 | 925 | 1 | 4.31 | 1.452 | 5.08 | 1.411 | *10.9 | * 36 | * 7 | // |

Note: A value marked with *falls outside the range as defined in the present invention

Fig. 4

| Test No. | Steel | Cold rolling | | | Magnetic characteristics | | | | Crystal grains | | Areal percentage of grains having orientation deviation within ±15 degrees from cubic orientation (%) | Surface oxide layer thickness (μm) | Remarks |
|---|---|---|---|---|---|---|---|---|---|---|---|---|---|
| | | Rolling reduction before intermediate annealing (%) | Intemediate annealing temperature (°C) | Rolling reduction after intermediate annealing (%) | Core less in rolling direction $W_{17/50}$ (W/kg) | Magnetic flux density in rolling direction $B_{10}$ (T) | Core loss in width direction $W_{17/50}$ (W/kg) | Magnetic flux density in width direction $B_{10}$ (T) | Ratio of average grain size to sheet thickness X/t | Areal percentage of grains having size of X/3-3X (%) | | | |
| 23 | E | 51.1 | * 740 | 86.4 | 2.20 | 1.572 | 2.24 | 1.561 | *10.1 | 64 | * 15 | 0.12 | Comparative Example |
| 24 | E | 73.3 | 960 | 75.0 | 1.35 | 1.765 | 1.45 | 1.732 | 3.2 | 81 | 81 | 0.15 | Present invention |
| 25 | E | 82.2 | 960 | 62.5 | 1.34 | 1.772 | 1.43 | 1.745 | 2.1 | 83 | 84 | 0.13 | // |
| 26 | E | 47.5 | * 740 | 85.7 | 2.35 | 1.532 | 2.32 | 1.545 | * 8.4 | * 53 | * 8 | 0.14 | Comparative Example |
| 27 | E | 70.0 | 1000 | 75.0 | 1.20 | 1.795 | 1.29 | 1.768 | 1.8 | 86 | 84 | 0.13 | Present invention |
| 28 | E | 77.5 | 960 | 66.7 | 1.05 | 1.832 | 1.09 | 1.815 | 2.4 | 91 | 95 | 0.12 | // |
| 29 | E | 65.7 | 1000 | 75.0 | 1.32 | 1.775 | 1.37 | 1.765 | 2.3 | 82 | 92 | 0.13 | // |
| 30 | E | 73.6 | 900 | 68.4 | 1.01 | 1.851 | 1.02 | 1.841 | 2.1 | 81 | 91 | 0.11 | // |
| 31 | E | 80.5 | 840 | 57.1 | 1.08 | 1.832 | 1.09 | 1.811 | 1.9 | 88 | 89 | 0.14 | // |
| 32 | E | 58.1 | 1000 | 76.9 | 1.21 | 1.791 | 1.27 | 1.765 | 1.8 | 85 | 83 | 0.12 | // |
| 33 | E | 66.1 | 940 | 71.4 | 0.91 | 1.901 | 0.90 | 1.885 | 2.1 | 85 | 97 | 0.10 | // |
| 34 | E | 72.6 | 940 | 64.7 | 0.92 | 1.875 | 0.99 | 1.865 | 2.0 | 89 | 96 | 0.11 | // |
| 35 | E | 16.0 | * 740 | 85.7 | 2.41 | 1.521 | 2.53 | 1.501 | 3.2 | * 55 | * 2 | 0.16 | Comparative Example |
| 36 | E | 74.0 | 860 | 53.8 | 0.97 | 1.854 | 1.05 | 1.841 | 2.2 | 89 | 93 | 0.13 | Present invention |
| 37 | E | 80.0 | 900 | 40.0 | 1.12 | 1.810 | 1.08 | 1.821 | 2.6 | 82 | 88 | 0.11 | // |
| 38 | E | 65.9 | 900 | 60.0 | 1.01 | 1.832 | 1.07 | 1.820 | 2.1 | 88 | 88 | 0.13 | // |
| 39 | E | 81.0 | * 730 | 28.6 | 2.71 | 1.472 | 2.89 | 1.452 | 5.4 | 68 | * 13 | 0.14 | Comparative Example |

Note: A value marked with *falls outside the range as defined in the present invention (100) POLAR CHART

DOUBLY ORIENTED MAGNETIC STEEL SHEET AND METHOD FOR MANUFACTURING THE SAME

This application is a continuation of application Ser. No. PCT/JP97/03985, filed Oct. 30,1997.

TECHNICAL FIELD

The present invention relates to a magnetic steel sheet, having excellent magnetic characteristics for use in small-sized transformers and the like, and to a method for manufacturing the same.

BACKGROUND ART

Silicon steel sheets or magnetic steel sheets are used as materials for magnetic cores of motors, generators, or transformers and during such use are required to exhibit small loss and large magnetic flux density.

Conventionally, magnetic steel sheets are classified into non-oriented magnetic steel sheets and oriented silicon steel sheets. Usually, in order to reduce core loss through suppression of occurrence of eddy current, magnetic steel sheets are arranged in layers into a laminated structure for use as magnetic cores of electric machinery. In this case, magnetization is effected in parallel with a sheet surface. Non-oriented magnetic steel sheets, when magnetized in parallel with a sheet surface, exhibit good magnetic characteristics in every direction and thus are favorably used in small-sized motors and the like. By contrast, oriented silicon steel sheets, when magnetized in a specific direction parallel to a sheet surface, i.e. in a direction parallel to their rolling direction, exhibit particularly excellent magnetic characteristics, but, when magnetized in other directions, have magnetic characteristics inferior to those of non-oriented magnetic steel sheets. Accordingly, oriented magnetic steel sheets are used in the form of combined laminated cores or wound cores, so that the rolling direction always corresponds to the direction of magnetization, thus enabling manufacture of transformers having a smaller loss.

An iron crystal has magnetic anisotropy. When a single crystal of iron is modeled as a cube, excellent magnetic characteristics are exhibited when magnetization is effected in a direction perpendicular to a face of the cube, i.e. in the direction of the <001> axis. In an oriented silicon steel sheet, the <001> axes of most iron crystal grains are parallel to a rolling direction, and the {110} planes are parallel to a sheet surface. This {110}<001> orientation is usually called Goss-orientation. A non-oriented magnetic steel sheet is manufactured under manufacturing conditions substantially similar to those for manufacture of an ordinary cold-rolled steel sheet, whereas an oriented silicon steel sheet is manufactured by the steps of cold-rolling steel containing Si in an amount of about 3%, subjecting the cold-rolled steel sheet to ordinary recrystallization annealing, and further annealing the recrystallized steel sheet at high temperature. During the high-temperature annealing, there must be carried out the so-called secondary recrystallization, in which Goss-oriented crystal grains are selectively grown through aid of sulfides and nitrides called inhibitors.

An oriented silicon steel sheet shows excellent magnetic characteristics in a rolling direction, but shows poor magnetic characteristics in other directions since the <001> axes of iron crystal grains constituting the steel sheet hardly exist in other directions. Accordingly, in an application such that magnetization is concurrently effected in a direction parallel to a rolling direction, and in a direction perpendicular to a rolling direction, as in the case of EI cores, a sufficient effect is not produced.

In contrast, if there is a steel sheet having a crystalline structure in which the <001> axes are parallel to a rolling direction, and the {100} planes are parallel to a sheet surface, the steel sheet exhibits excellent magnetic characteristics in a direction parallel to a rolling direction, and in a direction perpendicular to the rolling direction. In order to obtain a highly efficient small-sized transformer, such a steel sheet may not be formed into a wound core, but may be formed into an ordinary laminated core, such as an EI core or L core. Such a magnetic steel sheet having the {100}<001> orientation is called a doubly oriented magnetic steel sheet. Various methods for manufacturing a doubly oriented magnetic steel sheet have been studied, but a method has not been developed for manufacturing a doubly oriented magnetic steel sheet having satisfactory magnetic characteristics.

There is a known method for manufacturing a doubly oriented magnetic steel sheet, studied in the 1950s, in which a silicon steel sheet, having a thickness not greater than 0.3 mm, is annealed at a high temperature of 1200° C. in a highly pure inert gas. In this method, during the process of high-temperature annealing, secondary recrystallization is effected through use of surface energy as a driving force, so as to grow {100}<001>-oriented crystal grains, thereby obtaining the crystalline structure of a doubly oriented magnetic steel sheet. However, the crystalline structure of a steel sheet manufactured by this method is coarse, and crystal grains have as large a size, as near 100 times the thickness of the steel sheet. The steel sheet fails to provide satisfactory magnetic characteristics and involves a problem of a large core loss when applied to a magnetic core.

Recently, there has been developed a magnetic steel sheet, having a crystalline structure, which is composed of relatively fine columnar crystal grains and in which the {100} planes are parallel to the surface of the steel sheet, as disclosed, for example, in Japanese Patent Application Laid-Open (kokai) No. 1-108345, etc.

According to the manufacturing method disclosed in Japanese Patent Application Laid-Open (kokai) No. 1-108345, a steel sheet containing C, Mn, and Si in appropriate amounts, and having a predetermined thickness, is first heated in a vacuum or in a weak decarburizing atmosphere so as to be gradually decarburized. In this case, the decarburization temperature range is such that steel in an austenite ($\gamma$) region, or a two-phase region of austenite and ferrite ($\gamma+\alpha$), assumes complete ferrite ($\alpha$) phase through decarburization down to a very low carbon concentration, sufficiently below 0.01%. Through gradual decarburization at a temperature in such a range, crystals having the <001> axis perpendicular to a sheet surface, or the {100} plane parallel to a sheet surface, are generated in a surface layer at high density. Subsequently, the steel sheet undergoes secondary decarburization annealing in a strong decarburizing atmosphere, in such a temperature range, that core steel is at the $A_1$ point or higher, and is not higher than the temperature of the above primary decarburization annealing, so as to grow $\alpha$ grains from a sheet surface and sufficiently decarburize the entire steel sheet. As a result, there is obtained a magnetic steel sheet having numerous crystals whose {100} planes are parallel to a sheet surface.

In a surface layer, crystals having {100} planes parallel to a sheet surface grow well, particularly under gradual decarburization, for the following reason. Since the surface energy of the {100} plane of a ferritic grain is lower than that of a plane of another orientation, the ferritic grains grow preferentially. Also, the thinner the layer of the a phase, the greater the difference in the surface energy. The thus-formed ferritic grains in the surface layer serve as nuclei and grow into the interior of the steel sheet, while transformation is effected by decarburization and progresses from the γ phase to the α phase.

According to another manufacturing method, disclosed in Japanese Patent Application Laid-Open (kokai) No. 1-252727, a steel sheet which undergoes final annealing in the above-mentioned method, is formed through a plurality of rolling steps, with intermediate annealing performed therebetween, to thereby obtain a silicon steel sheet having the {100}<001> crystallographic texture and an average grain size not greater than 1 mm. However, a crystalline structure obtained by this method is such that columnar crystal grains growing from both surfaces of a steel sheet toward the interior of the steel sheet collide at the central portion of the steel sheet, thereby becoming a fine structure whose grain size is about half the sheet thickness or smaller. In order to prevent the formation of a fine structure, annealing time may be extended so as to further grow crystal grains. However, the extension of annealing time causes the crystalline structure to become a duplex grain structure. The formation of a duplex grain structure causes a decrease in the strength of the {100}<001> crystallographic texture, and an impairment in magnetic characteristics represented by core loss.

According to still another manufacturing method, disclosed in Japanese Patent Application Laid-Open (kokai) No. 7-173542, a tight coil of a steel sheet, with an oxide-based annealing separator held between spirals, or a lamination, composed of the oxide-based annealing separator and steel sheets arranged in alternating layers, is subjected to decarburization annealing under reduced pressure, to thereby grow in sheet surfaces a crystallographic texture having {100} planes parallel to the sheet surfaces through a single execution of annealing. Further, according to the publication, through selection of an adequate annealing separator, the removal of manganese can be effected during decarburization annealing, and this removal of manganese can accelerate the development of {100} plane orientation. However, in a magnetic steel sheet manufactured by this method, {100} planes are parallel to a sheet surface, but the <001> axes in a sheet surface are oriented differently from cubic orientation; thus the magnetic steel sheet has a {100}<052> type crystallographic texture. Accordingly, the method disclosed in Japanese Patent Application Laid-Open (kokai) No. 7-173542, cannot be said to be that for developing the {100}<001> crystallographic texture.

As mentioned above, there are proposed several methods for manufacturing a magnetic steel sheet in which {100} planes are parallel to a sheet surface. However, in magnetic steel sheets manufactured by these methods, the orientation of the <001> axes in a sheet surface is different from that of {100}<001>, and even when the {100}<001> crystallographic texture is formed, magnetic characteristics are unsatisfactory. Accordingly, oriented magnetic steel sheets manufactured by these methods involve a problem of failure to exhibit satisfactory characteristics.

SUMMARY OF THE INVENTION

The present invention provides a magnetic steel sheet suited for application to, for example, small-sized transformers and EI cores, and having excellent magnetic characteristics in two directions, i.e. in a rolling direction and a direction perpendicular to a rolling direction, as well as a method for manufacturing the same.

The inventors of the present invention conducted various studies based on the aforementioned method disclosed in Japanese Patent Application Laid-Open (kokai) No. 7-173542, in which {100} plane orientation is developed through tight coil annealing or laminate annealing. Specifically, the inventors studied a method for manufacturing a magnetic steel sheet, having a cubic orientation of {100}<001>, as well as crystalline structure and compositional distribution in the interior of a steel sheet.

A {100} plane-oriented crystal is formed by a surface energy difference between the {100} plane and a plane of another orientation, in the α phase formed through recrystallization in the surface of steel, or in the α phase formed through transformation from the γ phase. Accordingly, it is difficult to attain a {100} plane-oriented crystal whose axis is oriented in a specific direction with respect to the rolling direction of a sheet. However, according to the findings of the above studies, {100} plane-oriented crystal grains can be influenced, so as to obtain cubic orientation, through the appropriate selection of the chemical composition of steel and cold-rolling and annealing conditions.

These conditions include: (1) the chemical composition of steel must be such that a two-phase region of α+γ is established during hot rolling, or at least in a finish rolling step in the latter half of hot rolling; (2) cold rolling must be performed at least twice while intermediate annealing is performed at least once therebetween, and intermediate annealing must be performed at least once in a two-phase region of α+γ through quick heating; and (3) in final finish annealing for developing {100} plane orientation through use of surface energy, a steel material to be decarburized must be in a two-phase region of α+γ, and must assume the α phase through decarburization or through decarburization and removal of manganese from the surface of the steel.

During the growth of {100} plane-oriented crystals effected by surface energy in the surface of steel, when the α phase is formed through the decarburization of the γ phase, the obtained {100} plane orientation does not have an axis oriented in a specific direction in a sheet plane, whereas, when the α phase is formed through the decarburization of the α+γ phase, the obtained {100} plane orientation may have an axis oriented in a specific direction with in a sheet plane. This derives from the influence of crystallographic texture of the α+γ phase. Accordingly, relevant measures are employed so as to establish the α+γ phase from the stage of hot rolling, and intermediate annealing during cold rolling is performed through quick heating, so as to establish a two-phase region of α+γ. As a result, a cubic orientation of {100}<001> is markedly developed when {100} plane orientation is formed through decarburization, or through decarburization and removal of manganese in final annealing.

In the case of steel, a crystallographic texture is not intensively formed by rolling while the steel is in the high temperature region of the γ phase. However, the crystallographic texture tends to be markedly formed by rolling while the steel is in the temperature region of the a phase or α+γ phase. Even when the crystallographic texture is formed by rolling while the steel is in the α phase, randomization occurs during heating-effected transformation from the α phase to the γ phase. Accordingly, by performing hot rolling in the α+γ phase, and performing intermediate annealing in the α+γ phase through quick heating, the base material heated at the time of forming a thin-layered α phase through surface decarburization in final annealing assumes the $\alpha+\gamma$ phase, which strongly holds traces of the influence of a crystallographic texture, formed by rolling and intermediate annealing. The thus-formed $\alpha+\gamma$ phase accelerates the formation of a cubic orientation of {100}<001>.

A temperature elevation rate in intermediate annealing has a significant effect on the formation of a cubic orientation effected after final annealing, conceivably for the following reason: quick heating suppresses the formation of a crystallographic orientation which would be formed by slow heating, and thus a more preferable crystallographic orientation formed in final annealing is preferentially sustained. In order to reliably avoid slow heating, an effective measure is to limit the elapsed time for passing a most influential temperature range.

Even when the crystallographic orientation of an obtained steel sheet is favorable, if the ratio of grain size to sheet thickness is excessively small or large, magnetic characteristics become poor. Accordingly, controlling the ratio of grain size to sheet thickness is important. In this case, not only is controlling the average of ratios of individual grain sizes to sheet thickness important, but so is narrowing the distribution of the ratios. In other words, a uniform grain structure, not a duplex grain structure, is particularly important in terms of the improvement of magnetic characteristics.

In a study of a singly oriented silicon steel sheet, excessively large crystal grains are conventionally known to cause coarsening of magnetic domains with a resultant increase in eddy current loss. Coarsened magnetic domains are refined through introduction of strain effected by irradiation with a laser. However, for doubly oriented magnetic steel sheets, the form in which the influence of grain size emerges is unknown.

There was a study of doubly oriented silicon steel sheets, having a coarse structure in which grain size is near 100 times sheet thickness, or those having a very fine structure in which a grain size is not greater than half of sheet thickness. However, these doubly oriented silicon steel sheets have been found to be unsatisfactory in terms of core loss. From other various studies the inventors of the present invention found that such a problem can be solved through control of the ratio of grain size to sheet thickness. This solution derives from a magnetic domain structure, peculiar to a doubly oriented silicon steel sheet.

According to the magnetic domain structure of a singly oriented silicon steel sheet, two kinds of strip-shaped magnetic domains extending in a rolling direction are alternated in the width direction of the sheet, one magnetic domain having the direction of magnetization aligned with a rolling direction, and the other having the direction of magnetization aligned with the opposite direction of rolling. By contrast, a doubly oriented silicon steel sheet has three kinds of magnetic domains having respective directions of magnetization; specifically, in a rolling direction, in the width direction of the sheet, and in a direction perpendicular to the surface of the sheet. Since the rate of presence and size of the magnetic domains depend greatly on the ratio of grain size to sheet thickness, control of the ratio is important in terms of reduction of core loss.

When the ratio of grain size to sheet thickness is not greater than 1 in the interior of a steel sheet, there exist numerous magnetic domains, having the direction of magnetization perpendicular to a sheet surface, thereby forming dosed magnetic paths on the surface of the steel sheet. The presence of the dosed magnetic paths suppresses magnetization in the interior of the steel sheet, resulting in an increase in core loss. When the ratio of grain size to sheet thickness is in excess of 1, magnetic domains having the direction of magnetization perpendicular to a sheet surface disappear, so that core loss decreases. However, when the ratio is in excess of 8, there results a drastic increase in the width of magnetic domains having the direction of magnetization within the surface of a steel sheet, and these magnetic domains interrupt magnetization with a resultant increase in core loss. Generally, grain sizes form a relatively wide distribution. However, when a crystallographic orientation difference among crystal grains is small, and crystal grains are of a small size, magnetic domains within adjacent crystal grains show a strong tendency to unite. Thus, a steel sheet must have as uniform a grain structure as possible, so as to exclude crystal grains whose sizes fall within a grain size range causing the interruption of magnetization.

Attainment of a significant improvement in magnetic characteristics has been attempted in a manner described above. Also, components of a steel sheet have been selected in an attempt to perform rolling in a two-phase region of $\alpha+\gamma$, under usually practiced hot rolling conditions and in consideration of rolling workability of the steel, texture to be subjected to annealing, etc. Further, rolling conditions, decarburizing conditions, etc. have been studied so as to clarify optimum manufacturing conditions to obtain a marked cubic orientation of {100}<001>. The present invention has been accomplished in this manner. The gist of the present invention resides in the following:

(1) A doubly oriented magnetic steel sheet, having excellent magnetic characteristics, characterized in that Si and Mn are contained in amounts, based on % by weight, satisfying following formulas (1), (2), and (3) or formulas (1), (2), and (4); the average size of crystal grains present in a cross section parallel to the surface of the sheet is 1 to 8 times the thickness of the sheet; and at least 60% of all crystal grains have a size of X/3 to 3X, where X is an average grain size.

$$Si(\%)+0.5\ Mn(\%)\leqq 4 \quad (1)$$

$$Si(\%)-0.5\ Mn(\%)\geqq 1.5 \quad (2)$$

$$Mn(\%)\geqq 0 \quad (3)$$

$$Mn(\%)\geqq 0.1 \quad (4)$$

Preferably, in the above doubly oriented magnetic steel sheet, crystal grains having a crystallographic orientation difference within ±15 degrees from a cubic orientation of {100}<001>, occupy an areal percentage of not less than 70%, or the thickness of a surface oxide layer of the steel sheet is not greater than 0.5 $\mu$m. In either case, the magnetic characteristics of the magnetic steel sheet become significantly excellent.

(2) A method for manufacturing a doubly oriented magnetic steel sheet, having excellent magnetic characteristics, comprising the steps of hot-rolling and cold-rolling steel containing C in an amount of 0.02% to 0.2% by weight, and Si and Mn in amounts, based on % by weight, satisfying the above formulas (1), (2), and (3) or formulas (1), (2), and (4) so as to obtain a steel sheet, having a predetermined thickness, wherein intermediate annealing is performed at least once during cold rolling; intermediate annealing is performed at least once at a temperature not lower than 750° C., and, during temperature elevation to the annealing temperature through the application of heat, a temperature zone ranging from 600° C. to 750° C. is passed in 2 minutes or less; and the obtained steel sheet is annealed under reduced pressure, while a substance for accelerating decarburization or a combination of a substance for accelerating decarburization and a substance for accelerating the removal of manganese is used as an annealing separator.

In the above method for manufacturing a doubly oriented magnetic steel sheet, preferably, a rolling reduction is 40% to 85% in cold rolling performed before and after intermediate annealing in order to obtain further excellent magnetic characteristics.

BRIEF DESCRIPTION OF THE DRAWINGS

FIG. 1 is a table showing the chemical composition of steel obtained through vacuum melting and subsequent casting and used as materials to be tested in Examples 1 and 2;

FIG. 2 is a table showing intermediate annealing conditions employed in Example 1, magnetic characteristics of a steel sheet, properties of crystal grains, and the thickness of a surface oxide layer;

FIG. 4 is a table showing cold rolling conditions, magnetic characteristics of steel sheets, properties of crystal grains, and the thickness of a surface oxide layer in Example 2.

BEST MODE FOR CARRYING OUT THE INVENTION

1. Chemical Composition

Figure 3:
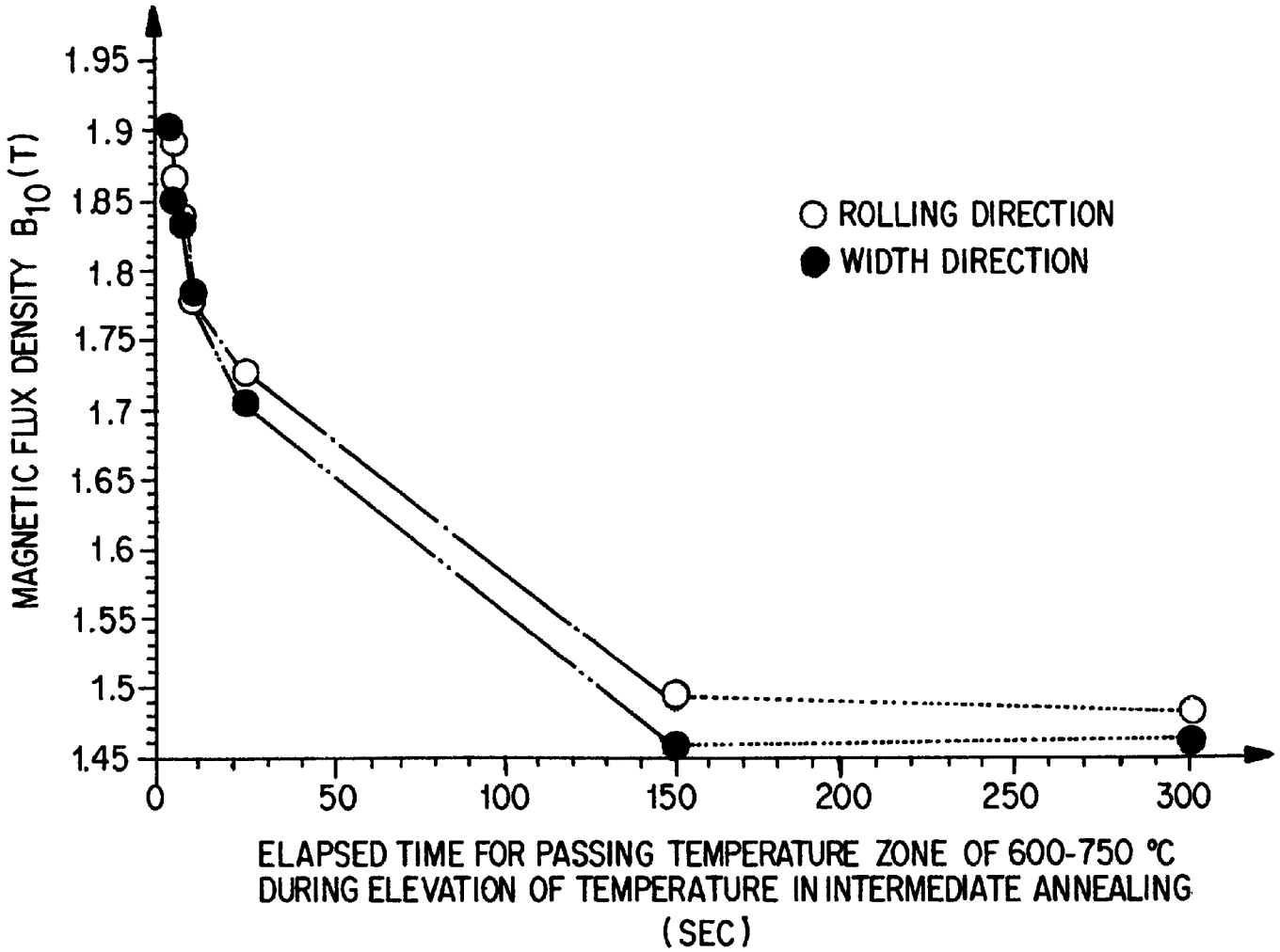
FIG. 3 is a graph showing the relationship between elapsed time for passing a temperature zone of 600° C. to 750° C. during heating accompanied by elevation of temperature in intermediate annealing performed during cold rolling and the magnetic flux density of a steel sheet as measured after final annealing.

C causes a significant impairment in magnetic characteristics of a magnetic steel sheet. Accordingly, the lower the carbon content, the better. The carbon content is preferably up to 0.005% at most. However, since in a manufacturing process, crystallographic texture control is performed through utilization of transformation from $\alpha+\gamma$ to $\alpha$ effected in association with decarburization, steel stock must contain C in an amount of not less than 0.02%. When the carbon content of steel stock is less than 0.02%, the $\alpha$ phase may be singly established before decarburization is performed, resulting in a failure to form a crystallographic texture through utilization of transformation. By contrast, when the carbon content of steel stock increases, not only does carburization take a longer time, but also the rolling becomes more difficult. Thus, the carbon content is up to 0.2% at most. That is, the carbon content of the steel stock is 0.02% to 0.2%. In order to make stable transformation from $\alpha+\gamma$ to $\alpha$ and improve carburization efficiency, while workability is held intact, the carbon content is preferably 0.04% to 0.08%.

Mn may not be contained. However, Mn, when contained, has the effect of decreasing core loss through the increase of electric current. Also, when a crystallographic texture is formed through decarburization, the removal of manganese may also be effected, thereby more effectively developing a preferred orientation. In order to produce such an effect, Mn may be preferably contained in an amount not less than 0.2%, more preferably not less than 0.3% for attainment of stable, excellent magnetic characteristics. However, since the removal of manganese is effected in final annealing, a final product preferably contains Mn in an amount of not less than 0.1%.

Si has the effect of decreasing eddy current loss, which constitutes part of core loss, through the increase of electric resistance. Further, the addition of Si produces the effect of increasing a temperature at which the $\alpha$ phase emerges through decarburization. When the silicon content is in excess of about 1.8%, the $\gamma$ phase disappears, irrespective of temperature, so long as decarburization is sufficiently effected. In order to form {100} plane orientation of the present invention, high-temperature processing in the $\alpha$ phase must be carried out. In this connection, when Si is contained in a sufficiently large amount, the $\alpha$ phase is singly formed with ease through decarburization. However, since the presence of Mn tends to lower a temperature at which the $\alpha$ phase emerges, the lower limit of the silicon content is specified according to the manganese content by the following formula (2). An increase in the silicon content embrittles steel, makes rolling difficult due to increased resistance to deformation, and decreases magnetic flux density. Also, an increase in the manganese content makes rolling difficult due to increased resistance to deformation. Thus, the upper limits of the silicon and manganese contents are specified by the following formula (1).

$$Si(\%)+0.5\ Mn(\%)\leqq 4 \quad (1)$$

$$Si(\%)-0.5\ Mn(\%)\geqq 1.5 \quad (2)$$

Al is added to steel for the purpose of reliably attaining soundness of the steel slab at the time of casting and for the purpose of fixing N. The addition of Al also produces the effect of improving magnetic characteristics through the increase of electric resistance. However, in the present invention, the lower the aluminum content, the better. This is because Al causes the formation of a nitride which impairs magnetic characteristics and causes the formation of an oxide in a sheet surface, at the time of decarburization annealing, with a resultant interruption of the formation of {100} plane orientation. The aluminum content is preferably not greater than 0.2% at most.

The content of unavoidable impurities is preferably as low as possible since their presence impairs workability or magnetic characteristics.

2. Rolling and Intermediate Annealing

Through use of the steel stock containing C in an amount of 0.02% to 0.2% and Si and Mn in amounts satisfying the above formulas (1) and (2), the $\alpha+\gamma$ phase is established, at least, in a temperature range of 750° C. to 1200° C.; thus, subsequent rolling is performed in the two-phase region under usually practiced hot rolling conditions. Through the employment of a certain combination of components, the two-phase state is established even at higher temperatures. Accordingly, even though specific conditions, such as a rolling temperature range are not set, an intensive crystallographic texture can be formed through rolling in a final rolling process. Steel stock to be hot-rolled may be a slab obtained through the blooming of ingot, a slab or a thin slab obtained through continuous casting, or the like so long as the requirements for chemical composition as specified in the present invention are met.

In a cold-rolling step subsequent to hot rolling, intermediate annealing is performed at least once during cold rolling. Particularly, when a thinner sheet is required, intermediate annealing may be performed twice or more. Intermediate annealing is performed at a temperature not lower than 750° C. corresponding to a two-phase region of $\alpha+\gamma$. For attainment of stabler magnetic characteristics, intermediate annealing is preferably performed at a temperature not lower than 850° C. Intermediate annealing may be performed at higher temperatures so long as the two-phase region is established. However, due to limitations of equipment and operation, the upper limit of temperature is preferably set at about 1200° C.

In intermediate annealing, a temperature elevation rate for heating is such that elapsed time for passing a temperature zone ranging from 600° C. to 750° C. does not exceed 2 minutes. If possible, it is preferable to use an annealing method enabling quick heating, such as the continuous annealing method. If heating accompanied by slow elevation of temperature is performed over this temperature range, uniform grains are not formed in final annealing, resulting in a failure to obtain satisfactory magnetic characteristics. Soaking time is not particularly limited. Soaking for about 10 seconds to 5 minutes is sufficient. Longer soaking merely causes an increase in energy loss associated with heating and is thus wasteful. Therefore, soaking time is determined as adequate in accordance with employed equipment.

As described above, in intermediate annealing performed during cold rolling, a steel sheet is heated to a temperature zone corresponding to the two-phase region at a relatively high temperature elevation rate so as to facilitate the formation of a cubic orientation of {100}<001> in final annealing. An increased heating rate conceivably influences the state of crystallographic texture and the state of distribution of fine precipitates in steel before final annealing. When intermediate annealing is to be performed a plurality of times, intermediate annealing is performed at least once through quick heating in the temperature zone corresponding to the two-phase region. This produces a satisfactory effect.

A rolling reduction in cold rolling performed before and after intermediate annealing is not particularly limited, but is preferably 40% to 85%. A rolling reduction falling outside this range develops a tendency to grow crystal grains having {100}<021> orientation, {100}<011> orientation, and {111} planes parallel to a sheet surface in final annealing. Consequently, magnetic characteristics are highly likely to be impaired. Particularly preferable is a rolling reduction in cold rolling performed after intermediate annealing is 45% to 70%.

3. Final Annealing

After rolling, an annealing separator, including a substance for accelerating decarburization or a substance for accelerating both decarburization and the removal of manganese, is interposed between steel sheets, so as to form a wound coil in the case of long steel sheets, or to form layers in the case of cut sheets. The thus-formed coil or laminate is annealed under vacuum of not greater than 100 Torr or under reduced pressure. Examples of a substance for accelerating decarburization include oxides such as $SiO_2$, $Cr_2O_3$, $TiO_2$, FeO, $V_2O_3$, $V_2O_5$, and VO.

According to a conventional method of decarburizing very-low-carbon steel sheets and magnetic steel sheets through annealing, annealing is performed in an hydrogen-containing wet atmosphere, adjusted so as to serve as a reducer for Fe and as an oxidizer for C contained in steel. Theoretically, decarburization progresses according to a reaction as represented by the following formula (5).

$$\text{C (solid phase)} + H_2O\text{(gaseous phase)} \rightarrow \text{CO(gaseous phase)} + H_2\text{(gaseous phase)} \quad (5)$$

In this case, C contained in steel is oxidized to become CO, thus progressing decarburization and oxidizing Si and Mn. C is readily removed because of its relatively high diffusion rate, whereas Si and Mn deposit on the surface of a steel sheet in the form of oxide. The thus-deposited oxides in the sheet surface change the energy state in the surface of the steel sheet, thus interrupting the development of {100} plane orientation, which would otherwise be effected by surface energy of the a phase in a surface layer. Further, oxygen diffuses into the interior of steel and induces so-called internal oxidation through combining with Si and the like present near a surface layer, thus impairing magnetic characteristics of the steel sheet.

In contrast, according to the present invention, an oxide is brought in contact with the surface of a steel sheet, and the steel sheet is exposed to a high temperature under reduced pressure. As a result, in the case of the oxide being $SiO_2$, decarburization progresses conceivably through reaction as represented by the following formula (6).

$$\text{C (solid phase)} + SiO_2\text{(solid phase)} \rightarrow \text{CO(gaseous phase)} + \text{SiO(solid phase)} \quad (6)$$

In this case, C and O (in the form of $SiO_2$) involved in the reaction are in a solid phase, and CO is in a gaseous phase. Accordingly, through the reduction of pressure, CO as a reaction product is intensively removed, thereby progressing decarburization. Further, since O ($H_2O$), which, if present, would oxidize Si and Mn, is not present in the gaseous phase, therefore their oxides are not generated in the surface of a steel sheet.

In high-temperature decarburization under reduced pressure, as represented by the above formula (6), the removal of manganese also progresses through the vaporization of Mn contained in steel. This removal of manganese is accelerated by an annealing separator. Examples of such an annealing separator include $TiO_2$, $Ti_2O_3$, and $ZrO_2$. These substances absorb vaporized manganese to thereby decrease a vapor pressure of manganese in the vicinity of the surface of a steel sheet, thus producing the effect of accelerating the removal of manganese. $TiO_2$ also accelerates decarburization. Accordingly, through the use of an annealing separator, which contains $TiO_2$ as a main component, decarburization and the removal of manganese can both be accelerated.

An annealing separator in the powdery form may be applied to a steel sheet. Alternatively, an annealing separator may be fibrous, in a sheet-like form composed of fibers, or in the form of fibers or sheet mixed with powder. The aforementioned oxides may be used singly or in a combination. Further, such an oxide may be mixed with a stabler oxide such as $Al_2O_3$ and a substance not directly related to the reaction, such as BN or SiC, so long as the effect of the oxide is not significantly impaired.

When a steel sheet in contact with an annealing separator is to be decarburized through the application of heat, the decarburization is favorably performed under reduced pressure or under vacuum, which pressure is preferably not greater than 100 Torr. If the pressure is in excess of 100 Torr, CO produced in a decarburizing reaction is not smoothly removed from the surface of a steel sheet, thus retarding the progress of the reaction and suppressing the sublimation of manganese, with a resultant interruption of the removal of manganese. Even at a pressure not greater than 100 Torr, decarburization may be disabled in the case of steel having a certain composition. Thus, more preferably, the pressure is not greater than 10 Torr. The lower the lower limit of the pressure, the better; i.e., the higher a vacuum, the better. However, the degree of vacuum is naturally limited according to industrial implementation.

As mentioned above, in decarburization performed under reduced pressure through use of a decarburization accelerator, used in the present invention, an oxide layer of Si and Mn is not formed or hardly formed, on the surface of a steel sheet. Normally, in annealing under atmospheric pressure, Si and Mn contained in steel are oxidized to form an oxide layer on the surface of a steel sheet. Such a surface oxide layer interrupts the movement of magnetic domain walls at the time of magnetization, causing an impairment in magnetic characteristics. This characteristic impairment becomes more conspicuous with a doubly oriented magnetic steel sheet having excellent magnetic characteristics. Thus, the thickness of a surface oxide layer is preferably not greater than 0.5 $\mu$m, more preferably not greater than 0.2 $\mu$m. In order to suppress the formation of a surface oxide layer, it is preferable that, for example, final annealing is performed at a reduced pressure not higher than 1 Torr while an oxide containing $SiO_2$ is used as a decarburization accelerator. Under this condition, the thickness of a surface oxide layer becomes not greater than 0.2 $\mu$m in most cases.

Decarburization annealing is performed at a temperature not lower than 850° C. in a two-phase region of $\alpha+\gamma$, and the $\alpha$ phase is singly formed through transformation which accompanies decarburization. Decarburization annealing may be performed at a higher temperature so long as the $\alpha$ phase is singly formed through decarburization. However, a temperature in excess of 1300° C. encounters difficulty in industrial attainment. The {100}<001> orientation can be formed most effectively at a temperature of 900° C. to 1200° C. After a layer of recrystallized grains, having the {100}<001> orientation, is formed on the surface of a steel sheet, a decarburization temperature does not need to be so high as mentioned above.

Soaking time in annealing ranges from 30 minutes to 100 hours. When soaking time is less than 30 minutes, in many cases, decarburization and the removal of manganese are insufficient, with a resultant poor growth of recrystallized grains, having the {100}<001> orientation in the surface of a steel sheet, and crystal grains of a steel sheet are poorly grown. By contrast, when soaking time is in excess of 100 hours, the effect of annealing is saturated, and grain size sometimes becomes excessively large, resulting in a mere wasteful consumption of energy.

Regarding annealing for flattening a steel sheet, insulation coating on the surface of a steel sheet, etc., it is possible to use conventional methods employed for non-oriented magnetic steel sheets and oriented magnetic steel sheets. Such a treatment does not have a significant effect on magnetic characteristics of a magnetic steel sheet, manufactured by the method of the present invention.

4. Grain Size

In order to reduce core loss, a magnetic steel sheet is preferably thinner. However, thinning a magnetic steel sheet is limited in view of an increase in cost, an increase in man-hours for lamination work involved in the manufacture of a core, or a reduction in space factor. Generally, a magnetic steel sheet is finished to obtain an appropriate thickness not greater than 0.5 mm. In this case, an average grain size of a steel sheet is made 1 to 8 times the thickness of the sheet, as measured on a cross section parallel to a sheet surface. When the ratio of average grain size (diameter) to sheet thickness is less than 1, numerous magnetic domains, having the direction of magnetization perpendicular to a sheet surface, are generated in the interior of a steel sheet and suppress magnetization in the interior of the steel sheet. Further, crystal grain boundaries cause a significant pinning effect of magnetic domain walls. These two actions cause an increase in core loss. By contrast, when the ratio of average grain size (diameter) to sheet thickness is in excess of 8, there is an increase in the width of magnetic domains, having the direction of magnetization within the surface of a steel sheet. As a result, a loss induced by abnormal eddy currents increases drastically, causing an increase in core loss.

Even when an average grain size falls within the range between 1 time to 8 times the sheet thickness, if a duplex grain structure is formed, magnetic domains within adjacent crystal grains show a strong tendency to unite. As a result, crystal grains whose sizes fall within a grain size range, which causes the interruption of magnetization, are apt to be generated and have a considerable effect on magnetization. Thus, a steel sheet must have a uniform grain structure as much as possible, so as to exclude crystal grains whose sizes fall within a grain size range, which cause the interruption of magnetization. A uniform grain structure required for obtaining good magnetic characteristics is such that at least 60% of all crystal grains have a size of X/3 to 3X, where X is an average grain size. Otherwise, satisfactory magnetic characteristics may not be obtained in many cases. In order to stably obtain excellent magnetic characteristics, preferably, an average grain size is 1.5 times to 5 times the sheet thickness, and at least 70% of all crystal grains have a size of X/3 to 3X, where X is an average grain size. The above-mentioned percentage is the percentage of the area of relevant crystal grains to the area of a field of observation.

5. Crystallographic Texture

In order to obtain a doubly oriented silicon steel sheet, having excellent magnetic characteristics, the {100}<001> texture must be developed in a steel sheet. When observed in a manner similar to that in observation of grain sizes, crystal grains whose orientational deviation from the {100}<001> orientation is within ±15 degrees preferably account for not less than 70% of a field of observation, more preferably not less than 80% of a field of observation. An orientation whose deviation from the {100}<001> orientation is within ±15 degrees refers to the following: when $\alpha$ represents the angle between a rolling direction and a <001> axis of a crystal grain, having the closest correspondence to the rolling direction, and $\beta$ represents the angle between a width direction and a <001> axis, having the closest correspondence to the width direction, the average of these angles, $(\alpha+\beta)/2$, is within 15 degrees.

The effects of a magnetic steel sheet of the present invention and of a method for manufacturing the same will now be described by way of example, Examples 1 and 2.

EXAMPLE 1

FIG. 1 is a table showing the chemical composition of steel obtained through vacuum melting and used as materials to be tested in Examples 1 and 2. Steel having the chemical composition of FIG. 1, obtained through vacuum melting and subsequent casting, was hot-forged to obtain a slab having a thickness of 80 mm. The thus-obtained slab was heated to 1200° C. and then hot-rolled to obtain the steel sheets, having a thickness of 3.3 mm, followed by acid pickling for descaling. Then, the descaled steel sheets were cold-rolled to a thickness of 1.0 mm, followed by intermediate annealing performed at various temperatures and for various periods of time. The intermediate-annealed steel sheets were further cold-rolled to obtain the steel sheets having a thickness of 0.35 mm. The thus-cold-rolled steel sheets were cut to obtain sheet pieces, each measuring 250 mm (width) by 600 mm (length).

FIG. 2 is a table showing intermediate annealing conditions employed in Example 1, magnetic characteristics of a steel sheet, properties of crystal grains, and the thickness of a surface oxide layer. The intermediate annealing conditions are elapsed time for passing a temperature zone of 600° C. to 750° C. during heating accompanied by elevation of temperature, annealing temperature, and annealing time.

Subsequently, sheet pieces were arranged in layers, such that an annealing separator and an accelerator for the removal of manganese were interposed between sheet pieces. The employed annealing separator was a fibrous substance containing 48 wt. % of $Al_2O_3$ and 51 wt. % of $SiO_2$ and applied at a density of 40 g/m$^2$. The employed accelerator for the removal of manganese was $TiO_2$ powder and applied at a density of 20 g/m$^2$. The thus-formed laminates were heated while a vacuum was drawn at $10^{-2}$ Torr, and soaked at 1065° C. for 24 hours thereby performing final annealing. The thus-annealed sheet pieces were found to contain carbon in an amount not greater than 0.0025%.

A test piece measuring 30 mm (width) by 100 mm (length) was obtained from each of the annealed sheet pieces along each of the rolling direction and the width direction perpendicular to the rolling direction. The test pieces were measured for magnetic characteristics in the lengthwise direction thereof, through use of the single-piece magnetic-characteristic-measuring apparatus. The average grain size was obtained by the steps of polishing the surface of a steel sheet, observing the texture through SEM, and obtaining it by the line-segment method. The orientation of each crystal grain was measured by the ECP (Electron Chanelling Pattern) method. The surface oxide layer thickness was obtained by measuring the thickness of a surface oxide layer, through use of SIMS (Secondary Ion Mass Spectrometry), after final annealing.

FIG. 2 shows the test conditions, the obtained magnetic characteristics of the steel sheets, properties of grains, and the surface oxide layer thickness. In test Nos. 1 to 7 of FIG. 2, the same D steel was used, and only the elapsed time for passing a temperature zone of 600° C. to 750° C., during heating in intermediate annealing, was changed.

FIG. 3 was created based on the results of test Nos. 1 to 7 and shows the relationship between elapsed time for passing a temperature zone of 600° C. to 750° C., during heating accompanied by elevation of temperature in intermediate annealing performed during cold rolling, and the magnetic flux density of a steel sheet, as measured after final annealing.

As seen from the result shown in FIG. 2, in the case of steel sheets manufactured from steel represented by steel I, J, K, and L, which fail to comply with the chemical composition range as defined in the present invention, satisfactory characteristics are not obtained even though they are manufactured in the same manufacturing steps as those of the invention. Also, even when a chemical composition falls within the range as defined in the present invention, if elapsed time for passing a temperature zone of 600° C. to 750° C. is long, i.e. a temperature elevation rate is low as in the case of test Nos. 1 and 2, a steel sheet having excellent characteristics in both rolling and width directions is not obtained, and the state of texture of the crystal grains and the crystal orientation are not as expected. By contrast, when the conditions as defined in the present invention are satisfied, the obtained doubly oriented magnetic steel sheets exhibit excellent characteristics.

EXAMPLE 2

Steel E shown in FIG. 1 was hot-forged to obtain a slab having a thickness of 80 mm. The obtained slab was heated to a temperature of 1200° C. and hot-rolled to obtain steel sheets, having various thicknesses between 2.2 mm and 4.5 mm. The obtained steel sheets were descaled through acid pickling. The descaled steel sheets were cold-rolled, while rolling reduction was varied in cold rolling performed before and after intermediate annealing, thus obtaining the steel sheets having a final thickness of 0.3 mm. In intermediate annealing, elapsed time for passing a temperature zone of 600° C. to 750° C. was 6 seconds, whereas soaking temperature was varied. Soaking time was 20 seconds.

The thus-cold-rolled steel sheets were cut to obtain sheet pieces, each measuring 250 mm (width) by 600 mm (length). Subsequently, sheet pieces were arranged in layers, such that an annealing separator and an accelerator for the removal of manganese were interposed between sheet pieces. The employed annealing separator was a fibrous substance containing 58 wt. % of $Al_2O_3$ and 42 wt. % of $SiO_2$ and applied at a density of 40 g/m$^2$. The employed accelerator for the removal of manganese was $TiO_2$ powder and applied at a density of 25 g/m$^2$. The thus-formed laminates were heated while a vacuum was drawn at $10^{-1}$ Torr, and soaked at 1100° C. for 24 hours to thereby perform final annealing. The thus-annealed sheet pieces were found to contain carbon in an amount not greater than 0.0015%. These sheet pieces were measured, under conditions similar to those of Example 1, for magnetic characteristics, average grain size, orientation of each crystal grain, and surface oxide film thickness, through use of the single-piece magnetic-characteristic-measuring apparatus.

Figure 5:
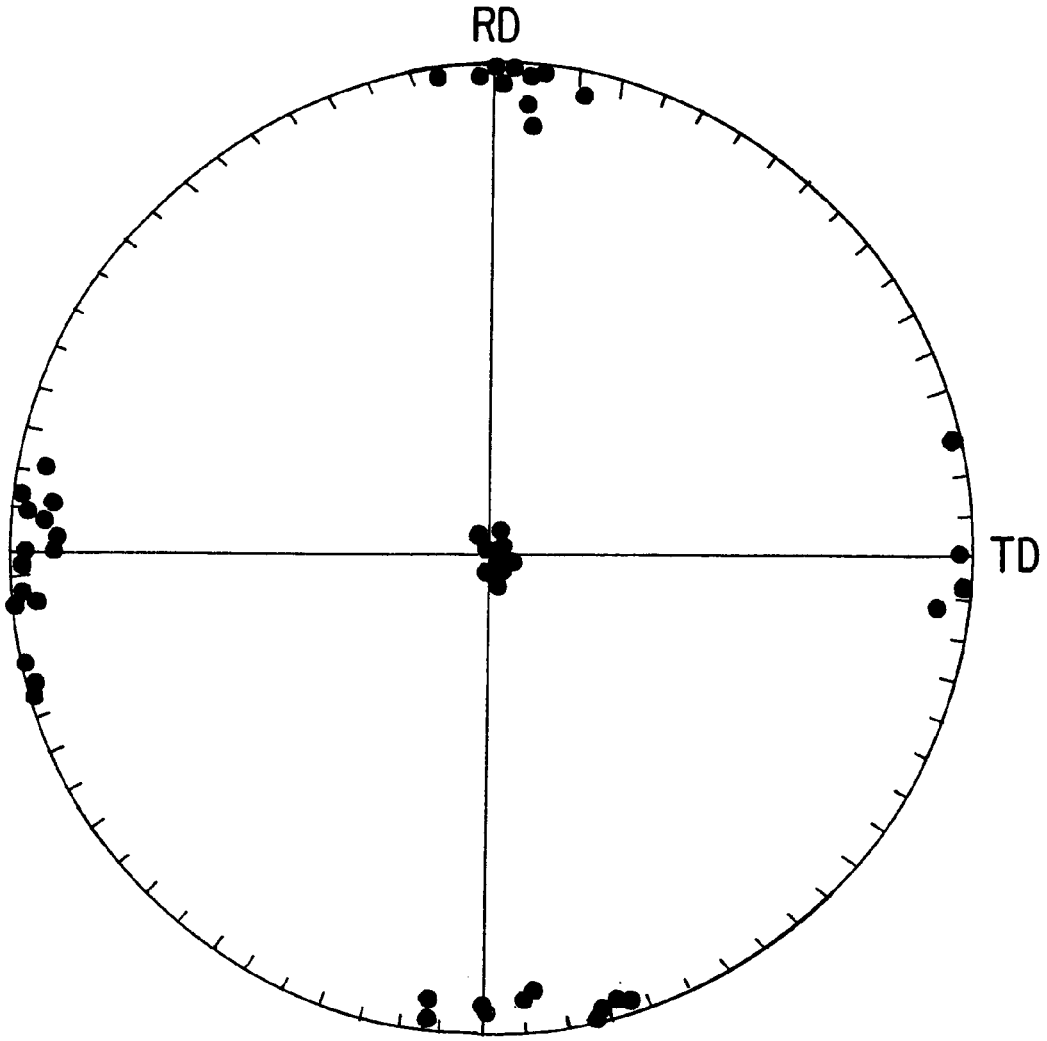
FIG. 5 is a (100) polar chart showing an orientation which shows favorable conformity to a cubic orientation of {100}<001>.

FIG. 4 is a table showing cold rolling conditions, magnetic characteristics of the steel sheets, properties of crystal grains, and surface oxide layer thickness in Example 2. The steel sheets were all manufactured from steel E, which complies with the chemical composition as defined in the present invention. However, the steel sheets of test Nos. 23, 26, 35, and 39 do not exhibit target magnetic characteristics. This is because the rolling reduction in cold rolling performed before or after intermediate annealing is slightly lower or higher than the desirable range as defined in the present invention, and the intermediate annealing temperature is excessively low. As a result, in these steel sheets, the ratio of average grain size to sheet thickness becomes excessively large, or crystal grains having a size of X/3 to 3X, where X represents an average grain size, occupy a relatively small area. Further, the crystallographic texture shows poor aggregation to a cubic orientation of {100}<001>. The steel sheet of test No. 25 was examined for orientation of each of the crystal grains constituting the steel sheet. The result is shown in FIG. 5. As seen from FIG. 5, there is established good aggregation to the (100)[001] orientation.

INDUSTRIAL APPLICABILITY

According to the method of the present invention, there is readily obtained a magnetic steel sheet having excellent magnetic characteristics in two directions, specifically, in a rolling direction and in a direction perpendicular to the rolling direction. Such a magnetic steel sheet is most suited to applications in which magnetic characteristics must be excellent in two perpendicular directions, such as EI cores and L cores of small-sized transformers. The use of such a magnetic steel sheet enables a reduction in the size of and an improvement in the efficiency of electric equipment.

Accordingly, the doubly oriented magnetic steel sheet of the present invention is most suited for use as material for cores of small-sized transformers and can be utilized in the field of manufacturing motors, generators, transformers, and the like.

What is claimed is:

1. A doubly oriented magnetic steel sheet, having excellent magnetic characteristics, comprising:

Si and Mn in amounts, based on % by weight, satisfying following formulas (1), (2), and (3);

the average size of crystal grains present in a cross section parallel to the surface of the sheet being 1 to 8 times the thickness of the sheet; and at least 60% of all crystal grains having a size of X/3 to 3X, where X is the average grain size:

$$Si(\%)+0.5\ Mn(\%) \leqq 4 \quad (1),$$

$$Si(\%)-0.5\ Mn(\%) \geqq 1.5 \quad (2), \text{ and}$$

$$Mn(\%) \geqq 0 \quad (3).$$

2. The doubly oriented magnetic steel sheet having excellent magnetic characteristics according to claim 1, wherein crystal grains having a crystallographic orientation difference within ±15 degrees from a cubic orientation of {100}<001> occupy an areal percentage of not less than 70%.

3. The doubly oriented magnetic steel sheet having excellent magnetic characteristics according to claim 1, wherein the steel sheet has a surface oxide layer thereon and the thickness of the surface oxide layer is not greater than 0.5 μm.

4. A doubly oriented magnetic steel sheet, having excellent magnetic characteristics, comprising:

Si and Mn in amounts, based on % by weight, satisfying following formulas (1), (2), and (4);

the average size of crystal grains present in a cross section parallel to the surface of the sheet being 1 to 8 times the thickness of the sheet; and at least 60% of all crystal grains having a size of X/3 to 3X, where X is the average gram size:

$$Si(\%)+0.5\ Mn(\%) \leqq 4 \quad (1),$$

$$Si(\%)-0.5\ Mn(\%) \geqq 1.5 \quad (2), \text{ and}$$

$$Mn(\%) \geqq 0.1 \quad (4).$$

5. The doubly oriented magnetic steel sheet, having excellent magnetic characteristics according to claim 4, wherein crystal grains having a crystallographic orientation difference within +15 degrees from a cubic orientation of {100}<001> occupy an areal percentage of not less than 70%.

6. The doubly oriented magnetic steel sheet having excellent magnetic characteristics according to claim 4, wherein the steel sheet has a surface oxide layer thereon and the thickness of the surface oxide layer is not greater than 0.5 μm.

7. The doubly oriented magnetic steel sheet having excellent magnetic characteristics according to claim 1, wherein the core loss $W_{17/50}$ in the rolling direction of the steel sheet is no greater than 1.56 W/kg.

8. The doubly oriented magnetic steel sheet having excellent magnetic characteristics according to claim 1, wherein the magnetic flux density $B_{10}$ in the rolling direction of the steel sheet is at least 1.725 T.

9. The doubly oriented magnetic steel sheet having excellent magnetic characteristics according to claim 1, wherein the core loss $W_{17/50}$ in the width direction of the steel sheet is no greater than 1.65 W/kg.

10. The doubly oriented magnetic steel sheet having excellent magnetic characteristics according to claim 1, wherein the magnetic flux density $B_{10}$ in the width direction of the steel sheet is at least 1.705 T.

11. The doubly oriented magnetic steel sheet having excellent magnetic characteristics according to claim 1, wherein the ratio of the average grain size to sheet thickness is 1.7 to 3.7.

12. The doubly oriented magnetic steel sheet having excellent magnetic characteristics according to claim 1, wherein the areal percentage of grains having a size of X/3 to 3X is at least 81%.

13. The doubly oriented magnetic steel sheet having excellent magnetic characteristics according to claim 2, wherein the percentage of grains having said crystallographic orientation is at least 85%.

14. The doubly oriented magnetic steel sheet having excellent magnetic characteristics according to claim 4, wherein the core loss $W_{17/50}$ in the rolling direction of the steel sheet is no greater than 1.56 W/kg.

15. The doubly oriented magnetic steel sheet having excellent magnetic characteristics according to claim 4, wherein the magnetic flux density $B_{10}$ in the rolling direction of the steel sheet is at least 1.725 T.

16. The doubly oriented magnetic steel sheet having excellent magnetic characteristics according to claim 4, wherein the core loss $W_{17/50}$ in the width direction of the steel sheet is no greater than 1.65 W/kg.

17. The doubly oriented magnetic steel sheet having excellent magnetic characteristics according to claim 4, wherein the magnetic flux density $B_{10}$ in the width direction of the steel sheet is at least 1.705 T.

18. The doubly oriented magnetic steel sheet having excellent magnetic characteristics according to claim 4, wherein the ratio of the average grain size to sheet thickness is 1.7 to 3.7.

19. The doubly oriented magnetic steel sheet having excellent magnetic characteristics according to claim 4, wherein the areal percentage of grains having a size of X/3 to 3X is at least 81%.

20. The doubly oriented magnetic steel sheet having excellent magnetic characteristics according to claim 5, wherein the percentage of grains having said crystallographic orientation is at least 85%.

* * * * *